US008641390B2

(12) United States Patent
Beck et al.

(10) Patent No.: US 8,641,390 B2
(45) **Date of Patent: *Feb. 4, 2014**

(54) LINEAR ROD PUMP APPARATUS AND METHOD

(75) Inventors: Thomas L. Beck, Union Grove, WI (US); Robb G. Anderson, Eden Prairie, MN (US); Ronald G. Peterson, Racine, WI (US); Michael A. MacDonald, Racine, WI (US)

(73) Assignee: Unico, Inc., Franksville, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/423,487

(22) Filed: Mar. 19, 2012

(65) Prior Publication Data

US 2012/0177504 A1 Jul. 12, 2012

Related U.S. Application Data

(62) Division of application No. 11/761,484, filed on Jun. 12, 2007, now Pat. No. 8,152,492.

(60) Provisional application No. 60/812,795, filed on Jun. 12, 2006.

(51) Int. Cl.
*F04B 17/00* (2006.01)

(52) U.S. Cl.
USPC ..... 417/415

(58) Field of Classification Search
USPC ..... 417/240, 415, 417; 166/77.51, 378
See application file for complete search history.

(56) References Cited

U.S. PATENT DOCUMENTS

| | | | | |
|---|---|---|---|---|
| 2,551,434 | A | 5/1951 | Gray et al. | |
| 3,741,686 | A * | 6/1973 | Smith | 417/240 |
| 4,114,375 | A | 9/1978 | Saruwatari | |
| 4,276,003 | A | 6/1981 | Perkins et al. | |
| 4,551,072 | A | 11/1985 | Barall | |
| 4,631,918 | A | 12/1986 | Rosman | |
| 4,788,873 | A | 12/1988 | Laney | |
| 4,836,497 | A * | 6/1989 | Beeson | 251/80 |
| 5,027,909 | A | 7/1991 | Carter et al. | |
| 5,429,193 | A | 7/1995 | Hegebarth et al. | |
| 6,015,271 | A | 1/2000 | Boyer et al. | |
| 7,168,924 | B2 | 1/2007 | Beck et al. | |

* cited by examiner

*Primary Examiner* — Peter J Bertheaud
(74) *Attorney, Agent, or Firm* — Reinhart Boerner Van Deuren s.c.

(57) ABSTRACT

An apparatus and method for pumping fluids, such as water and/or hydrocarbons, from a subterranean formation or reservoir, include a linear rod pump having a mechanical rack and pinion drive arrangement, adapted for attachment to a pumping mechanism, such as the polished rod at the top of a rod string in a hydrocarbon well. The rack gear, of the rack and pinion drive arrangement, is adapted for connection to, and movement with, the polished rod. The pinion gear does not translate with the rack gear, and is driven by a reversible motor for affecting up and down reciprocating motion of the rack gear and pumping mechanism. Some forms of the invention include a compressible gas counter-balance arrangement. Some forms of the invention include an electronic drive configured for dealing with electric power generated by the motor during a portion of the pumping cycle.

19 Claims, 14 Drawing Sheets

LINEAR ROD PUMP APPARATUS AND METHOD

CROSS-REFERENCE TO RELATED PATENT APPLICATIONS

This patent application is a Divisional Application of U.S. application Ser. No. 11/761,484, filed Jun. 12, 2007 now U.S. Pat. No. 8,152,492 and claims the benefit of U.S. Provisional Patent Application No. 60/812,795, filed Jun. 12, 2006, the disclosure and teachings of both applications are incorporated herein in their entireties, by this reference.

FIELD OF THE INVENTION

This invention relates to pumping of fluids, such as water and/or hydrocarbons, from subterranean formations or reservoirs, and more particularly to a pumping apparatus and method for use in such pumping applications.

BACKGROUND OF THE INVENTION

For many years, the familiar "horse head", walking beam-type mechanism has been used for pumping fluids such as water and/or oil from subterranean formations. An example of such a walking beam apparatus 50, connected to a polished rod 52 extending from a well head 54 of a well 56, is illustrated as prior art in the attached FIG. I.

Conventional walking beam apparatuses have a number of disadvantages, not the least of which is their large size. In addition, performance of the walking beam pump apparatus is largely a function of the design and connection of a number of mechanical parts, which include massive counter-weights and complex drive mechanisms which are difficult to control for obtaining maximum pumping efficiency or to compensate for changes in condition of the well over time.

As shown in FIG. 1, because of their large size and weight, walking beam-type pumping mechanisms must typically be mounted on a heavy concrete foundation 58, which may be poured in place or pre-cast, located adjacent the well head 54. Construction of a walking beam pumping mechanism, together with its foundation, typically involves the efforts of several construction workers, over a period which may be a week or more, to prepare the site, lay the foundation 58, and allow time for the foundation 58 to cure, in addition to the time required for assembling the various components of the walking beam mechanism 50 onto the foundation 58 and operatively connecting the mechanism to the polished rod 52. In general, because of the costs of transporting the apparatus and the concrete or pre-cast foundation to what may be a remote site and the complexity of the site preparation and assembly process, walking beam-type pumping mechanisms are generally only utilized in long-term pumping installations.

The large size and massive weight of the walking beam pumping mechanism and its foundation are also problematic when the well 56 is decommissioned. Economic and contractual obligations may require complete removal of the walking beam mechanism and its foundation. It is desirable, therefore, to provide an improved apparatus and method for operating the well 56, which eliminates, or at least greatly reduces, the significant expenditures in time, manpower, and money required to install and remove a pumping apparatus used for extracting fluid from the well 56.

Another disadvantage of walking beam-type pumping apparatuses is that they cannot typically operate at pumping speeds much below 5 strokes per minute. As a result, it has been necessary in the past, to only pump intermittently or to decommission wells which could not sustain pumping at rates of at least 5 strokes per minute, even though such wells would be capable of continued operation at lower pumping speeds. Intermittent pumping creates problems caused by varying levels of fluid in the well casing and tubing and collection of contaminants into the pump during "off" periods. As mentioned above, decommissioning a well equipped for pumping with a walking beam-type mechanism is an arduous and costly task. Further, government regulations frequently require the costly process of sealing the well 56 with cement or other sealing means when a well is decommissioned. It would be desirable, therefore, to provide an improved apparatus and method, for pumping fluid from the well 56, which could operate at considerably slower pumping rates than a walking beam-type mechanism, in a form that could be connected to the polished rod 52 in place of a walking beam mechanism 50, at an existing well 56, to thereby extend the useful life of the well 56 by operation at a pumping speed lower than could otherwise be accomplished by the walking beam-type apparatus. If such an improved pumping apparatus and method were available in a form that could be quickly and simply installed on an existing well 56, the necessity for, and cost related to, decommissioning the well, and in particular the cost related to sealing the well and removal of the walking beam mechanism and its foundation could be deferred, perhaps indefinitely, while the well 56 is operated at a low pumping rate.

Because of their large size and complexity, walking beam-type pumping mechanisms typically need to be shut-down and repaired on site. Although there have been attempts in the past to develop portable walking beam apparatuses, such as those described in U.S. Pat. No. 4,788,873, to Laney, such portable walking beam pumping apparatuses have not gained widespread acceptance in the art. It would be desirable, therefore, to have an improved pumping apparatus and method, in which the pumping apparatus could be readily transported to a well, and quickly installed in place of an existing walking beam apparatus, or another one of the improved pumping apparatuses previously attached to the well, to thereby substantially reduce downtime of the well during the process of performing maintenance and/or repairs of the pumping apparatus. It would also be desirable for such an improved pumping apparatus and method to allow for convenient installation and/or removal of the improved pumping apparatus, substantially in a completely assembled form, which could be initially assembled, or repaired, offline, at a location remote from the well, while the well was continuing to operate with another of the improved pumping apparatuses.

Another problem inherent in the use of walking beam-type pumping apparatuses is that the apparatus must typically extend a substantial distance above ground level in order to achieve a desired pumping stroke length on the order of 3 to 6 feet. At such substantial heights it may be difficult, if not impossible, to operate irrigation equipment, for example, in close proximity to the walking beam pumping apparatus, where such irrigation equipment must pass over the top of the walking beam apparatus. U.S. Pat. No. 6,015,271, to Boyer et al. discloses a stowable walking beam pumping unit having a foldable support structure to allow storage of the pumping unit in a low profile position. A stowable walking beam pumping unit, as disclosed by Boyer, has not been shown to be commercially viable, however. It is desirable, therefore, for an improved pumping apparatus and method to be operable in a form having a low enough profile that other equipment, such as irrigation pipes mounted on rolling supports can safely pass above the pumping apparatus.

U.S. Pat. No. 4,114,375, to Saruwatari discloses replacing the conventional walking beam pumping apparatus with a pump jack device including a double acting piston and cylinder motor, with the piston rod of the motor being adapted to be connected to the polished rod projecting upwardly from a well head. A variable displacement hydraulic pump, driven by a motor or engine, is included in a closed hydraulic loop wherein conduits are connected to a pair of output ports of the pump. A pump control means controls the direction and volume of flow in the loop so as to establish the stroke of the piston rod. A compressible fluid counter-balance is provided for accumulation of energy during a down stroke of the piston rod so that the energy may be returned to the piston during the upstroke. The counter-balance cylinder may be mounted coaxially above the motor and an additional closed chamber may be provided in fluid communication with a charged chamber of the counter-balance.

To date, the apparatus of Saruwatari has not achieved commercial success.

Regardless of the type of pumping apparatus utilized, controlling and optimizing the performance of a sucker-rod pumping apparatus involves inherent difficulties. One factor which must be taken into account is the stretching of the rod string, which occurs during the upward portion of each pump stroke, and the corresponding contraction of the rod string which occurs during the downward portion of each pump stroke. The rod string, which may be 1000 feet or more long, acts much like an extension spring, which is stretched during the portion of the pump stroke in which the rod string is drawing the fluid upward within the well, and which then contracts back to an essentially un-stretched state as the rod string moves downward during a return portion of the pump stroke. As a result of the rod stretch, an above-ground upward stroke of 32 inches, for a well approximately 1300 feet deep, may only result in a down-hole stroke in the range of 24 to 26 inches, for example. The difference between the magnitude and direction of movement of the polished rod at the top of the well and the corresponding reaction of the rod string and down-hole stroke of the pump involves other complicating factors, including inherent damping within the rod string, fluid damping which occurs during the pump stroke and longitudinal vibrations and natural frequencies of the rod string.

An additional difficulty occurs where the fluid being pumped upward from the well contains a significant amount of entrained gas. In such circumstances, a suction effect during the upward stroke of the rod string causes the entrained gas to bubble out of the fluid and form a foamy segment at the top of the column of fluid being pulled upward toward the surface through action of the down-hole components of the sucker-rod pump. Specifically, a typical down-hole pump portion of a sucker-rod pump, apparatus is located at the bottom of a length of tubing terminating in a fluid outlet above the surface of the ground and includes a standing valve, located at the lower end of the down-hole pump, and a traveling valve, which is attached to the bottom end of the rod string and is movable by the rod string within the down-hole pump above the standing valve. The standing valve performs a check-valve function which allows fluid to flow into the lower end of the down-hole pump when the pressure within the down-hole pump is lower than the pressure in the well casing outside of the down-hole pump. When pressure within the down-hole pump is equal to, or greater than, the pressure outside of the down-hole pump, the check-valve function of the standing valve closes to preclude movement of fluid out of the down-hole pump through the standing valve. The traveling valve also includes a check-valve function, which works substantially oppositely to the check-valve function of the standing valve. When the pressure within the down-hole pump below the traveling valve is lower than the pressure within the tubing above the traveling valve, the traveling valve is closed. Conversely, when the pressure within the down-hole pump below the traveling valve is greater than the pressure within the tubing above the traveling valve, the traveling valve opens and allows fluid movement through the traveling valve, so that the traveling valve can descend through the fluid in the down-hole pump.

By virtue of this arrangement, as the rod string pulls the traveling valve upward, during the upward portion of the pump stroke, the traveling valve is closed, and the upward motion of the traveling valve within the tubing generates a suction in the down-hole pump below the traveling valve which causes the standing valve to open and allow fluid to be drawn upward into the portion of the down-hole pump between the standing and traveling valves. Where the sucker-rod pump is pumping a fluid with no entrained gas, as soon as the rod string begins the downward portion of its stroke, the standing valve closes and the stationary valve opens, to thereby trap fluid within the down-hole pump above the standing valve, and allow the traveling valve to move downward through the trapped fluid within the down-hole pump, toward the standing valve, to the bottom of the pump stroke, where the rod string reverses direction and begins to pull the traveling valve upward at the start of the next pump stroke.

For the above-mentioned exemplary well, pumping water for dewatering coal bed methane and having a depth of approximately 1300 feet, the fluid load being moved upward by each stroke of the pump once the entire length of tubing has been filled, for example, would be 5400 pounds, and the weight of the rod string would be approximately 1800 pounds. As a result, during each stroke of the pump, the load on the rod string varies approximately by the 5400 pound fluid load, which causes a significant change in the length of the rod string, as the rod string stretches and contracts during each pump stroke. Fluid damping effects which occur as a result of the movement of the traveling valve upward and downward through fluid within the tubing and viscous effects related to the flow of the fluid upward within the tubing also affect the dynamic performance of the rod string.

Other complications also occur in wells having a fluid in the form of a liquid having entrained gas. In these wells, the traveling valve does not open immediately as it begins the downward portion of its movement within the down-hole pump, due to the presence of the foamy portion of the fluid column existing between the traveling valve and the liquid portion of the fluid column. The traveling valve must travel downward in the down-hole pump some distance while compressing the gas which has foamed out of the fluid before the suction effect dissipates to the point where the pressure difference across the traveling valve is such that the traveling valve can open.

As will be readily understood by those having skill in the art, accurately predicting the down-hole performance of the sucker-rod pump for a given input at the polished rod above the surface of the ground is a challenging design problem, with the specific difficulties discussed briefly above being far from totally inclusive.

The problems of effectively and efficiently operating a sucker-rod pump apparatus are addressed in significantly greater detail in a commonly assigned U.S. Pat. No. 7,168,924 B2, to Beck et al., titled "Rod Pump Control System Including Parameter Estimator." The Beck et al. patent also discloses a rod pump control system, which includes a parameter estimator that determines, from motor data, parameters relating to operation of the rod pump and/or generating a down-hole dynamometer card, without the need for external instrumentation such as down-hole sensors, rod load sensors, flow sensors, acoustic fluid level sensors, etc. In some embodiments disclosed by Beck et al., having a pumping apparatus driven by an electric motor, instantaneous current and voltage, together with pump parameters estimated through the use of a computer model of the sucker-rod pump, are used in determining rod position and load. The rod position and load are used to control the operation of the rod pump to optimize operation of the pump. Beck et al. also discloses a pump-stroke amplifier that is capable of increasing pump stroke without changing the overall pumping speed, or in the alternative, maintaining the well output with decreased overall pumping speed.

The commonly assigned Beck et al. patent, also provides a detailed description of the considerable additional complexity involved in operating a sucker-rod pump with a walking beam pumping apparatus, or with prior belt driven pumping units, and further provides a method and apparatus for efficiently and effectively controlling a sucker-rod pumping apparatus having a rod string driven by a walking beam pumping apparatus, or other types of previously-known pumping apparatuses.

With regard to the present invention, the detailed descriptions within Beck et al., of the manner in which the inherent difficulties of operating a sucker-rod pump apparatus are compounded by a complex pumping apparatus such as the typical walking-beam-type apparatus serve as ample evidence of the desirability of providing a new and improved pumping apparatus for use with a sucker-rod pump, which is not subject to the multitude of complexities involved in controlling prior pumping apparatuses such as the typical walking-beam-type pumping apparatus.

Even though the performance of walking-beam pump and other types of prior pumping apparatuses can be substantially improved through practicing the teachings of Beck et al., it is, therefore, still highly desirable to provide an improved apparatus and method for use in pumping fluids such as water and/or hydrocarbons from subterranean formations and reservoirs in a form overcoming problems such as, and in addition to, those discussed above. It is further desirable that such improvements be provided in a form which is considerably smaller in physical size than conventional walking beam apparatuses and also in a form which is less complex and more readily controllable and/or adjustable than prior conventional walking beam-type apparatuses. It is further desirable that such an improved apparatus and method provide advancements over the pump jack device of Saruwatari, in a form that is commercially viable.

BRIEF SUMMARY OF THE INVENTION

The invention provides an improved apparatus and method for pumping fluids, such as water and/or hydrocarbons, from a subterranean formation or reservoir, through use of a linear rod pumping apparatus having a linear mechanical actuator arrangement and a reversible motor operatively connected for imparting reciprocating, substantially vertical motion to a rod string of a sucker-rod pump. The linear mechanical actuator arrangement has a substantially vertically movable member attached to the polished rod of the sucker-rod pump for imparting and controlling vertical motion of the rod string of the sucker-rod pump. The reversible motor has a reversibly rotatable element thereof operatively connected to the substantially vertically movable member of the linear mechanical actuator arrangement in a manner establishing a fixed relationship between the rotational position of the motor and the linear position of the vertically movable member.

Apparatus and methods, in accordance with the present invention, have demonstrated their commercial viability, and the considerable advantages that can be obtained through practice of the invention, during operational field testing on actual hydrocarbon wells.

There is provided a linear rod pumping apparatus for imparting reciprocating substantially vertical motion to a rod of a sucker-rod pump having a pump stroke. The apparatus includes a linear mechanical actuator arrangement, a motor having a reversibly rotable element, and a control arrangement operatively connected to the motor for controlling the motor.

The linear mechanical actuator arrangement includes a substantially vertically movable member attached to the rod of the sucker-rod pump for imparting and controlling vertical motion of the rod of the sucker-rod pump. The linear mechanical actuator arrangement further includes a rack and pinion gearing arrangement, with the rack being disposed for operation in a substantially vertical direction for reciprocating motion along a pumping axis.

The rack is operatively connected in gear mesh relationship with the pinion. The pinion is operatively connected to the rotating output of the motor such that rotation of the motor in a first direction is accompanied by a substantially vertical upward motion of the rack along the pumping axis and such that a substantially vertical downward motion of the rack along the pumping axis is accompanied by rotation of the motor rotable element in a second direction opposite the first direction. The rack is also operatively connected to the rod of the sucker-rod pump for imparting vertically upward motion to the rod of the sucker-rod pump along the pumping axis when the rack is moving upward. The rack is further operatively connected to the rod of the sucker-rod pump such that the rod of the sucker-rod pump exerts a substantially vertically downward directed force on the rack, acting substantially along the pumping axis, during a portion of the pump stroke.

The motor is operatively connected to the vertically movable member of the linear mechanical actuator arrangement establishing a fixed relationship between the rotational position of the motor and the vertical position of the vertically movable member.

The control arrangement controls the motor and operates the motor in a driving mode to urge upward movement of the rack on an upward portion of the stroke of the rod pump. The control arrangement also operates the motor in a breaking mode during downward movement of the rack on a downward portion of the stroke of the pump rod. The control arrangement includes sensing arrangements for sensing one or more parameters of a group of parameters consisting of: linear position of the rack along the pumping axis, rotational position of the pinion upon the pinion axis, motor torque, motor speed, motor acceleration, and motor input power.

The control arrangement may further include an energy storage element for storing energy generated during the breaking mode of operation of the motor. The control arrangement in another embodiment is configured for utilizing the stored energy in the energy storage element to assist in driving the motor during the driving mode. In some embodiments, the control arrangement also includes a pump rod dynamics model for use in controlling operation of the motor. The sensing arrangements coupled to the control arrangement are configured to determine linear position of the rack twice during each pump cycle, once on the upstroke and once on the downstroke. The control arrangement is also configured, in some embodiments, for detecting a fault condition and applying corrective action to operation of the motor.

The invention may also be practiced in the form of a method for constructing, operating, maintaining, or replacing a linear rod pumping apparatus according to the invention.

In one form of the invention, a method is provided for operating a linear rod pumping apparatus including a linear mechanical actuator arrangement and a motor, where the linear mechanical actuator has a substantially vertically movable member configured for attachment thereto of the rod of a sucker-rod pump, to impart and control vertical motion of the rod of the sucker-rod pump. The motor has a reversibly rotatable element thereof, operatively connected to the substantially vertical member of the linear mechanical actuator arrangement establishing a fixed relationship between the rotational position of the rotatable element of the motor and the vertical position of the vertically movable member, with the method including, operating the motor in a manner imparting reciprocating substantially vertical motion to the vertically movable member. The method may further include determining dynamic operation of the pump rod, and controlling the motor in accordance with the dynamic operation of the pump rod.

A method, according to the invention, may include operating the motor in a driving mode, for applying torque to the rotatable element of the motor in a first direction to urge rotation of the rotatable element in the first direction and upward movement of the vertically movable member on an upward portion of a stroke of the pump rod. A method, according to the invention, may further include operating the motor in a braking mode, for applying a net torque to the rotatable element in the first direction, for resisting rotation of the rotatable element in the opposite direction during downward movement of the vertically movable member on a downward portion of the stroke of the pump rod.

In some forms of the invention, the motor generates energy during the braking mode, and a method, according to the invention, may further include extracting at least a portion of the generated energy during the braking mode of operation. The extracted energy may be utilized, in some forms of the invention, to assist in driving the motor during at least one of the driving and braking modes. Alternatively, the energy generated during the braking mode of operation of the motor may be dissipated.

The invention may also include controlling the motor in accordance with sensed values of one or more parameters selected from the group of parameters consisting of, linear position of the vertically movable member, rotational position of the rotatable element of the motor, motor torque, motor speed, motor acceleration, and motor input power. In some forms of the invention, one or more of the sensed values of parameters used for controlling the motor are sensed above-ground, rather than through the use of down-hole sensors. In some forms of the invention, all sensed values of the parameters used for controlling the motor are sensed above-ground.

Some forms of the invention may include detecting a fault condition, and taking corrective action to correct the detected fault. Some forms of the invention may include detecting a fault condition from the group of faults consisting of, loss of power to the motor, invalid or missed position reference, loss of control of the motor, non-filling of the pump, breakage and/or separation of the pump rod, and overheating of the motor.

In some forms of the invention, the corrective action taken may be one of a group of corrective actions from the group consisting of, applying braking, changing pump stroke length, changing pump stroke frequency, dwelling in a non-pumping state, operating the motor to slowly lower the rack to the lower mechanical limit of travel, and entering a start-up mode of operation.

In some forms of the invention, where a linear rod pumping apparatus, according to the invention, includes a position sensing arrangement having a stationary position sensor disposed adjacent the vertically movable member, approximately at a mid-stroke position thereof along the pumping axis, and a sensor flag attached to the vertically movable member and disposed such that the flag is juxtaposed with, and sensed by, the sensor during each pumping stroke, a method, according to the invention, may include detecting the vertical position of the vertically movable member by detecting juxtaposition of the flag with the sensor during each pump stroke.

In some forms of the invention, a sensing arrangement includes an upper sensor flag and a lower sensor flag, axially spaced from one another along the rack, to form a gap between the upper and lower flags, with the gap being substantially centrally longitudinally disposed along the rack. The upper sensor flag may extend substantially from the upper end of the rack to a lower edge of the upper sensor flag, defining an upper end of the gap between the upper and lower flags. In similar fashion, the lower sensor flag may extend substantially from the lower end of the rack to an upper edge of the lower sensor flag, to thereby define the lower end of the gap between the upper and lower sensor flags. Where such an arrangement is provided, a method, according to the invention, may include detecting the vertical position of the vertically movable member by detecting juxtaposition of the sensor with at least one of the upper and lower sensor flags during each pump stroke. A method may further include detecting an output of the sensor having a substantially square-wave shape, with a step change form a first state while one or the other of the lower flags is juxtapose with the sensor, to a second state when the gap is juxtapose with the sensor.

Other aspects, objects and advantages of the invention will be apparent from the following detailed description and accompanying drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 1:
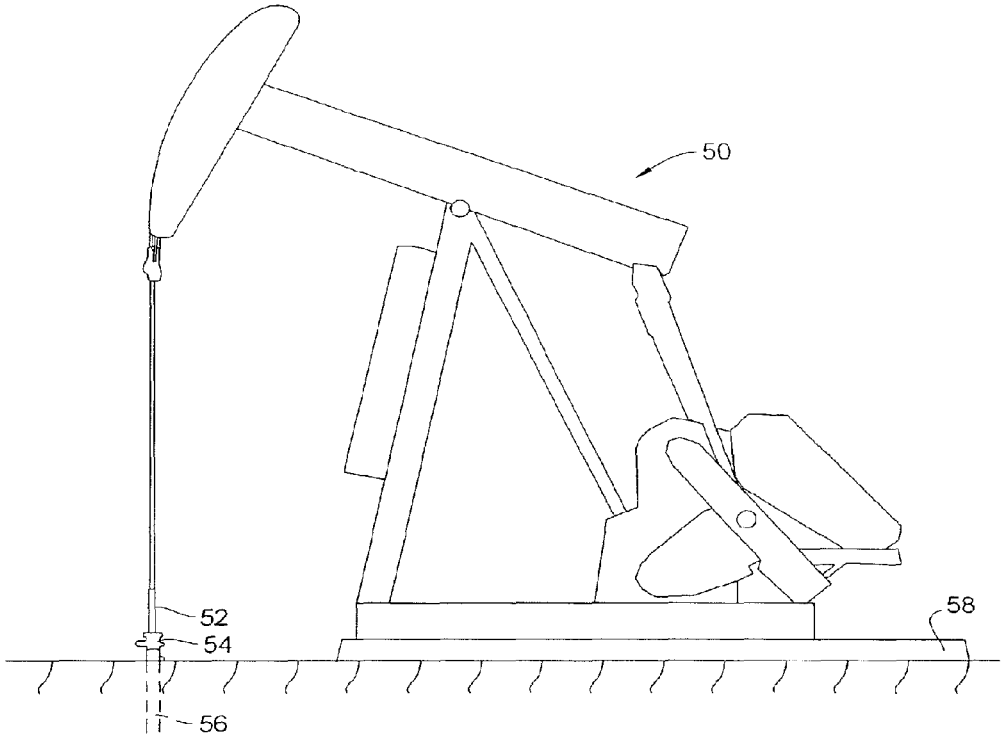
FIG. 1 PRIOR ART
FIG. 1, labeled as prior art, is a schematic illustration of a typical walking-beam-type pumping mechanism, mounted on a foundation located adjacent a well head of a hydrocarbon well, and attached to pump fluid from the hydrocarbon well.
Figure 2:
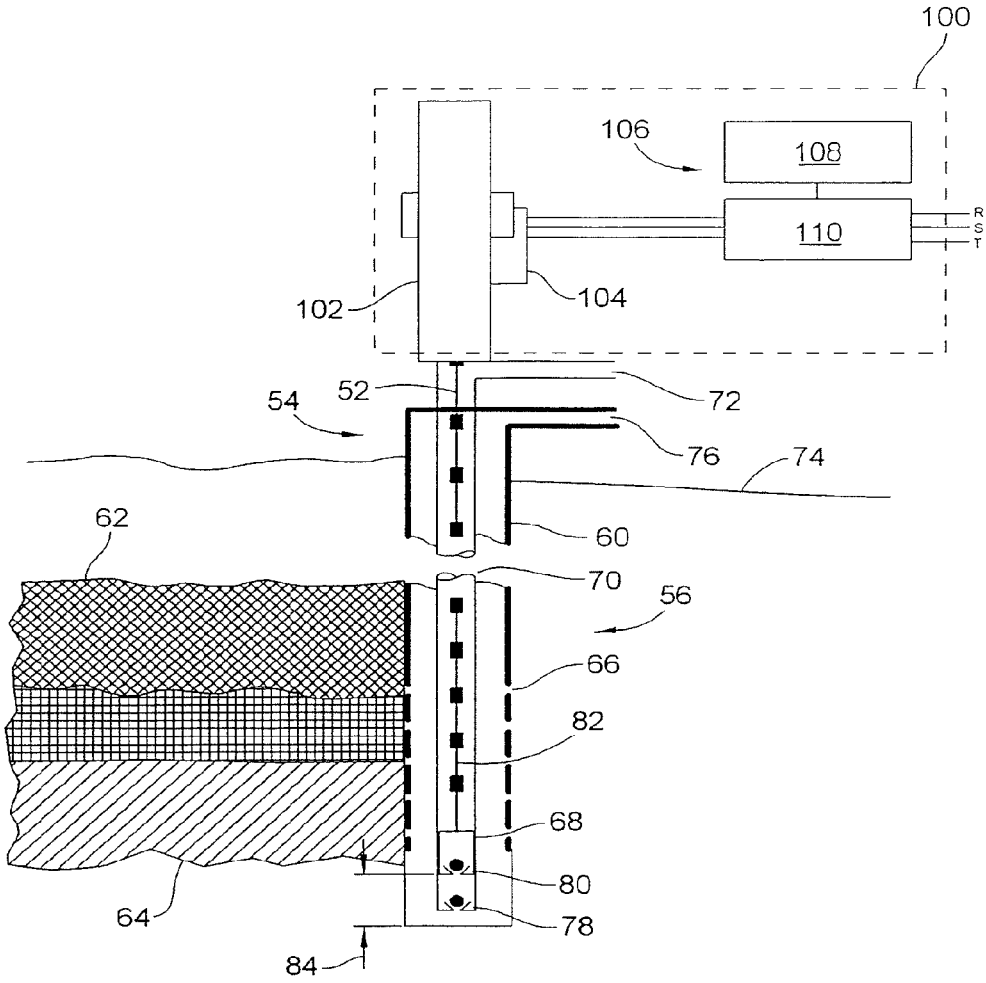
FIG. 2 is a schematic illustration of a first exemplary embodiment of a linear rod pumping apparatus, according to the invention, mounted on the well head of a hydrocarbon well.

FIG. 2 is a schematic illustration of a first exemplary embodiment of a linear rod pumping apparatus 100 mounted on the well head 54 of a hydrocarbon well 56. The well includes a casing 60 which extends downward into the ground through a subterranean formation 62 to a depth sufficient to reach an oil reservoir 64. The casing 60 includes a series of perforations 66, through which fluid from the hydrocarbon reservoir enter into the casing 60, to thereby provide a source of fluid for a down-hole pumping apparatus 68, installed at the bottom of a length of tubing 70 which terminates in an fluid outlet 72 at a point above the surface 74 of the ground. The casing 60 terminates in a gas outlet 76 above the surface of the ground 74.

The down-hole pumping apparatus 68 includes a stationary valve 78, and a traveling valve 80. The traveling valve 80 is attached to a rod string 82 extending upward through the tubing 70 and exiting the well head 54 at the polished rod 52. Those having skill in the art will recognize that the down-hole pumping apparatus 68, in the exemplary embodiment of the invention, forms a traditional sucker-rod pump arrangement for lifting fluid from the bottom of the well 56 as the polished rod 52 imparts reciprocal motion to rod string 82 and the rod string 82 in turn causes reciprocal motion of the traveling valve 80 through a pump stroke 84. In a typical hydrocarbon well, the rod string 82 may be several thousand feet long and the pump stroke 84 may be several feet long.

As shown in FIG. 2, the first exemplary embodiment of a linear rod pump apparatus 100, according to the invention, includes a linear mechanical actuator arrangement 102, a reversible motor 104, and a control arrangement 106, with the control arrangement 106 including a controller 108 and a motor drive 110. In all forms of the invention, the linear mechanical actuator arrangement 102 includes a substantially vertically movable member attached to the polished rod 52 for imparting and controlling vertical motion of the rod string 82 and the sucker-rod pump 68. The reversible motor of a linear rod pump apparatus, according to the invention, includes a reversibly rotatable element thereof, operatively connected to the substantially vertically movable member of the linear mechanical actuator arrangement 102 in a manner establishing a fixed relationship between the rotational position of the motor 104 and the vertical position of the rack 206. As will be understood, by those having skill in the art, having a fixed relationship between the rotational position of the motor 104 and the vertical position of the polished rod 52 provides a number of significant advantages in the construction and operation of a sucker-rod pump apparatus, according to the invention.

Figure 3:
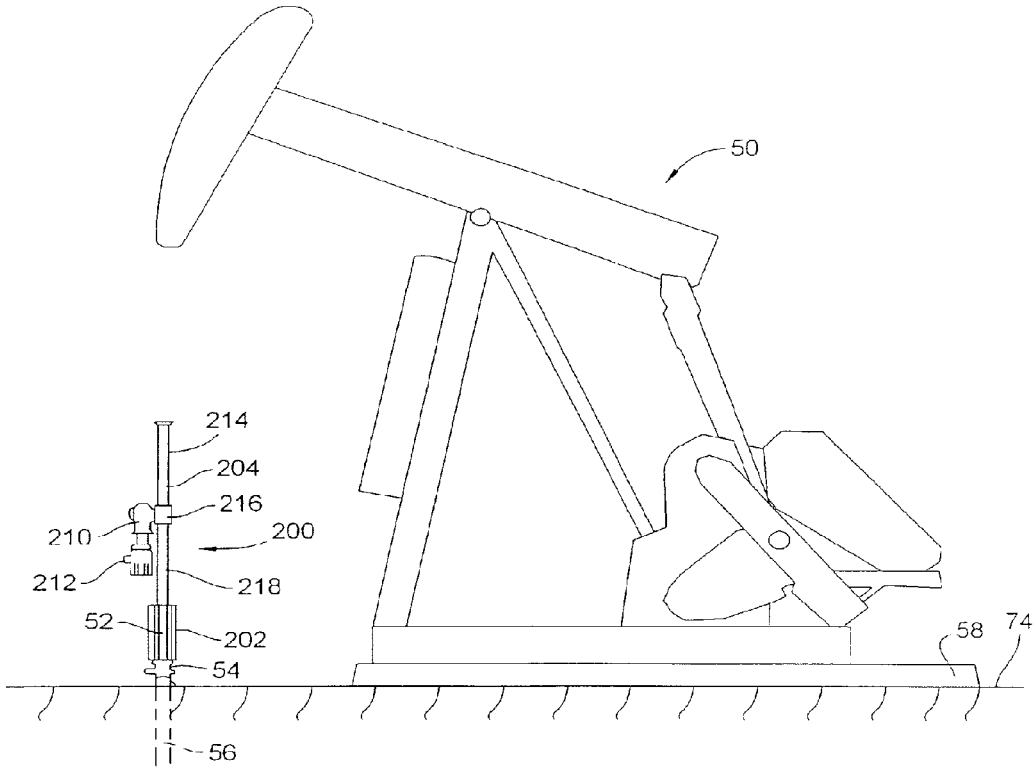
FIG. 3 is a schematic illustration of a second exemplary embodiment of a linear rod pumping apparatus, according to the invention, mounted on the well head of the well shown in FIG. 1, and operatively connected for pumping fluid from the well, instead of the walking beam apparatus, with the linear rod pumping apparatus and walking beam pumping apparatus being drawn to the same scale, to illustrate the substantial reduction in size and complexity of the linear rod pumping apparatus, according to the invention, as compared to a walking beam apparatus which was providing similar pumping output as the second exemplary embodiment of the linear rod pumping apparatus, according to the invention.
Figure 4:
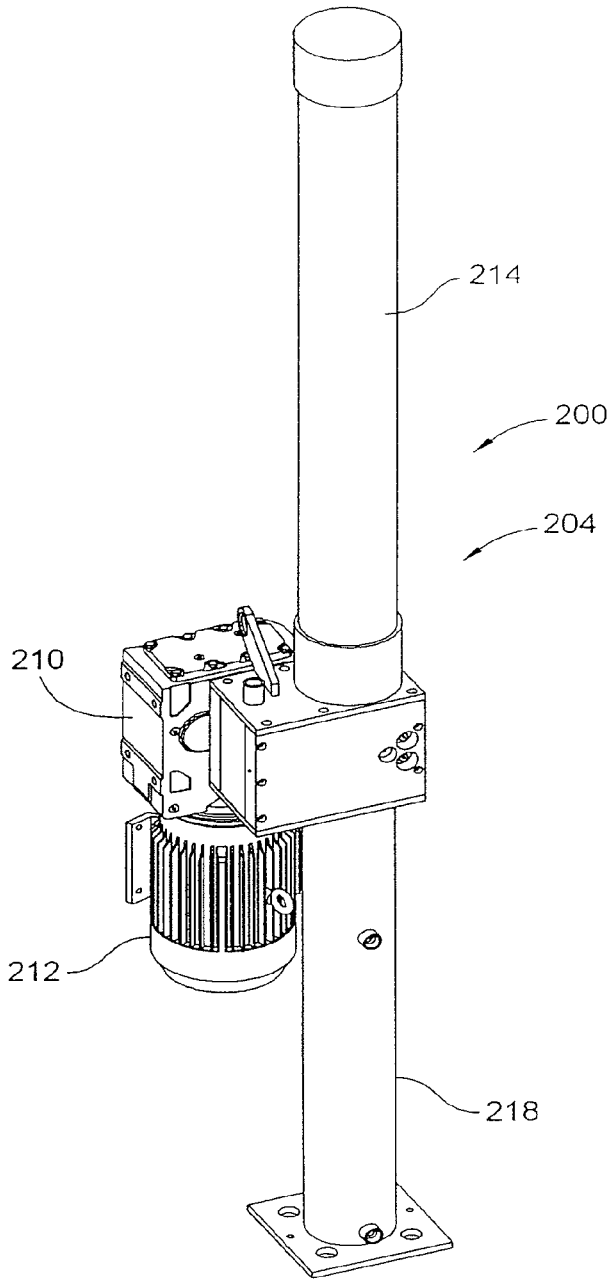
FIG. 4 is an external perspective view of the second exemplary embodiment of the linear pumping apparatus, according to the invention, shown in FIG. 3.
Figure 5:
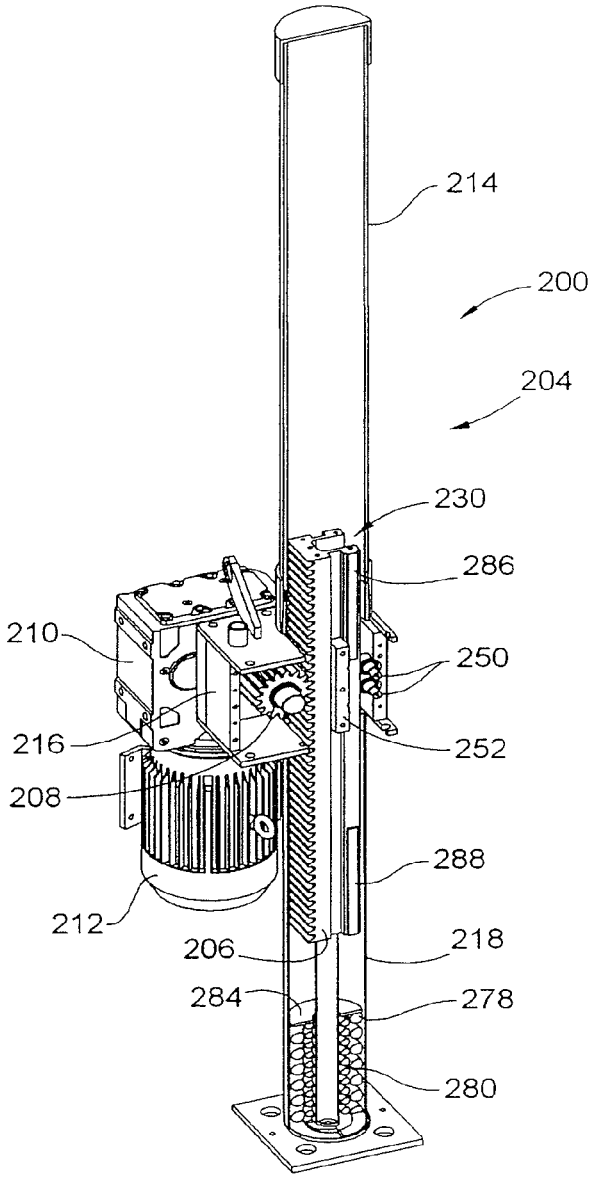
FIG. 5 is a partially cut-away perspective illustration of the second exemplary embodiment of a linear pumping apparatus, according to the invention, shown in FIG. 4.
Figure 6:
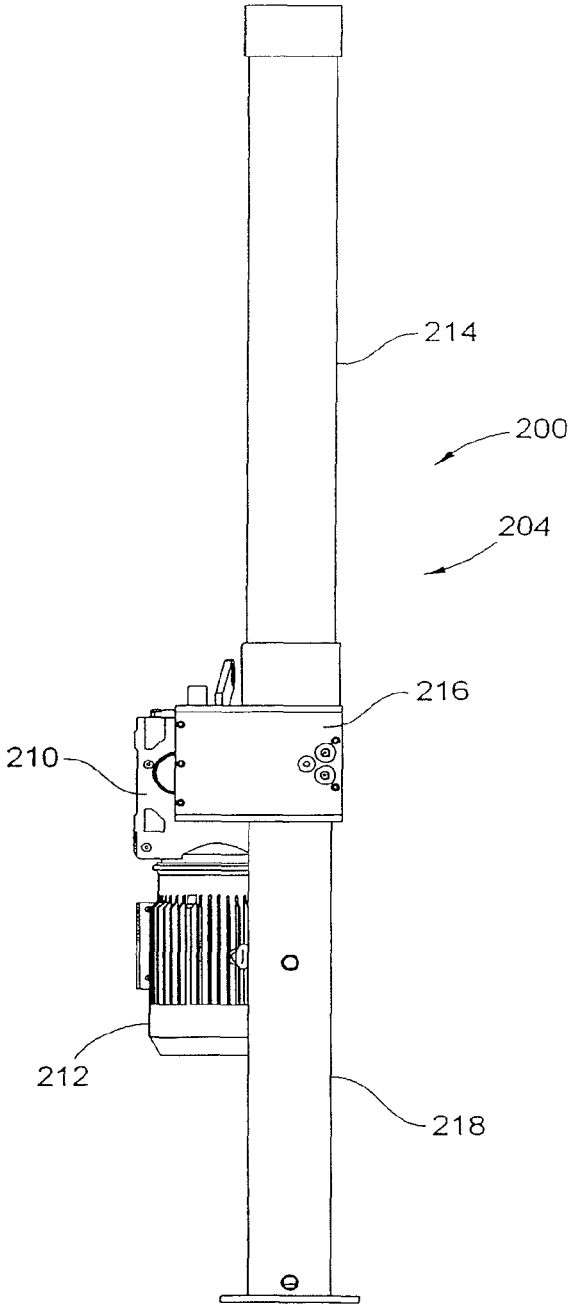
FIG. 6 is an exterior orthographic illustration of the second exemplary embodiment of the linear pumping apparatus, according to the invention, shown in FIGS. 3-5.

FIG. 3 shows a second exemplary embodiment of a linear rod pumping apparatus 200, according to the invention, mounted on a standoff 202 to the well head 54, and operatively connected for driving the polished rod 52. In FIG. 3, the second exemplary embodiment of the linear rod pumping apparatus 200 is illustrated to scale, adjacent to the walking beam pumping apparatus 50, to show the substantial reduction in size, weight, and complexity afforded through practice of the invention, as compared to prior approaches utilizing walking beam apparatuses 50.

It will be noted that an arrangement such as the one illustrated in FIG. 3, in which a linear rod pumping apparatus 200 is mounted adjacent a walking beam apparatus 50, might actually be observed in practicing the invention where the walking beam apparatus 50 is disconnected from the polished rod 52 and replaced by the linear rod pumping apparatus 200 to extend the life of the well 56 by utilizing the linear rod pumping apparatus 200 to pump at a slower rate than is possible through use of the walking beam apparatus 50.

It will be appreciated by those having skill in the art, that where a linear rod pumping apparatus 200 is used to replace a walking beam apparatus, or a previously installed embodiment of a linear rod pumping apparatus according to the invention, the replacement linear rod pumping apparatus 200 can be installed in a fully assembled form, or in a substantially fully assembled form, with only a minimal number of components, such as the upper section 214 of a housing, for example, being installed after the linear rod pumping apparatus 200 is installed on the well head 54. As will also be understood from the following description and inspection of the drawings, it may be desirable, in practicing the invention, to ship an otherwise substantially fully assembled linear rod pumping apparatus, according to the invention, with components such as the upper housing section 214 not installed, to thereby reduce the physical size of the linear rod pump 200 in a manner that is more compact to facilitate shipping and handling. As will be further understood, the compact size of a linear rod pumping apparatus according to the invention allows the linear rod pumping apparatus that is being replaced to be conveniently removed in a fully assembled or a substantially fully assembled form.

As shown in FIGS. 3-8, the second exemplary embodiment of the linear rod pumping apparatus 200, according to the invention, includes a linear mechanical actuator arrangement 204 which, in turn, includes a rack and pinion gearing arrangement having a rack 206 and a pinion 208 operatively connected through a gearbox 210 to be driven by a reversible electric motor 212 in a manner described in more detail below.

Figure 7:
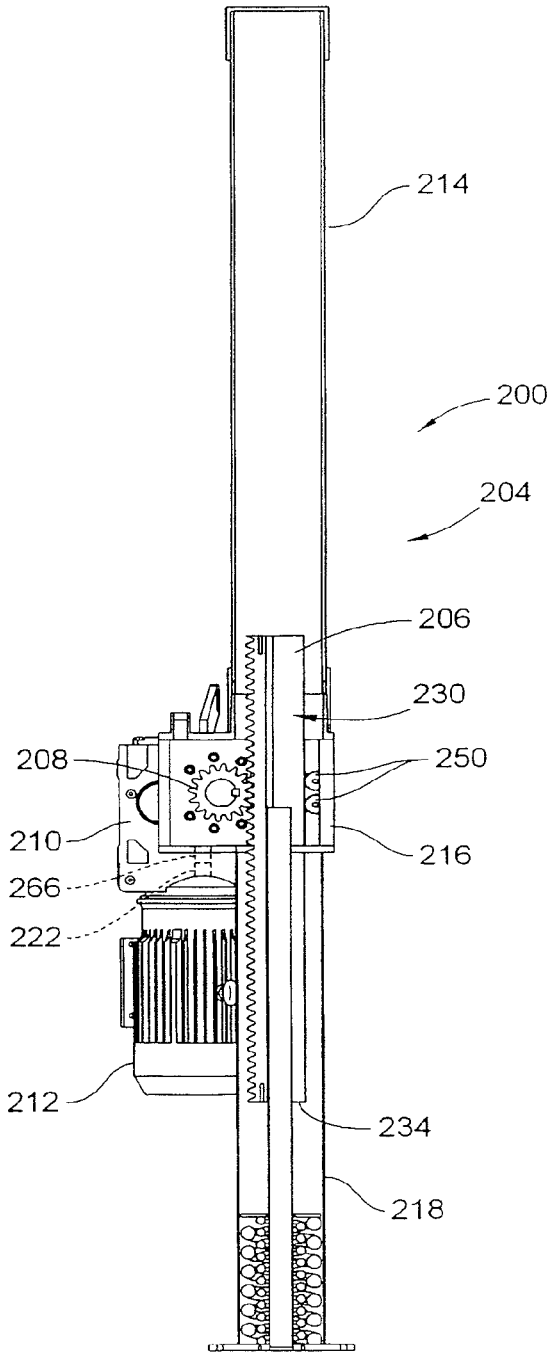
FIG. 7 is a partial cross-sectional illustration of the second exemplary embodiment of the linear rod pumping apparatus, according to the invention, shown in FIG. 6.
Figure 8:
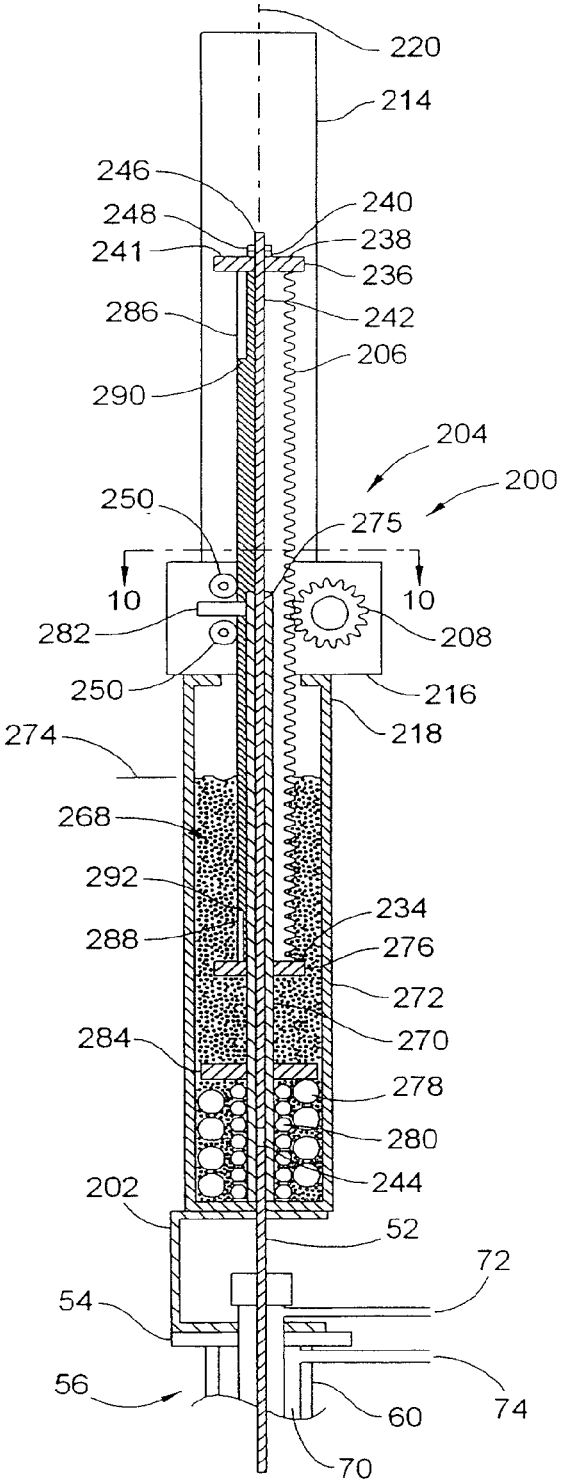
FIG. 8 is a schematic cross-section view of the second exemplary embodiment of the linear pumping apparatus, according to the invention, shown in FIGS. 3-7.

As shown schematically in FIG. 8, the linear mechanical actuator arrangement 204 of the second exemplary embodiment of the linear rod pumping apparatus 200 includes a rack and pinion gearing arrangement 206, 208 with the rack 206 being disposed for operation in a substantially vertical direction for reciprocating motion within a three piece housing having an upper, middle and lower section 214, 216, 218 along a substantially vertically oriented pumping axis 220. The rack 206 is operatively connected in gear mesh relationship with pinion 208 and the pinion 208 is operatively connected to a rotating output shaft 222 of the motor 212 (see FIG. 7) such that rotation of the motor output shaft in a first direction is accompanied by a substantially vertically upward motion of the rack 206 along the pumping axis 220, and such that a substantially vertically downward motion of the rack 206 along the pumping axis 220 is accompanied by rotation of the motor output shaft 222 in a second direction opposite the first direction. The rack 206 is also operatively connected to the polished rod 52 of the sucker-rod pump 68, such that the rack 206 cannot exert a substantially vertically downward directed force on the polished rod 52.

Figure 9:
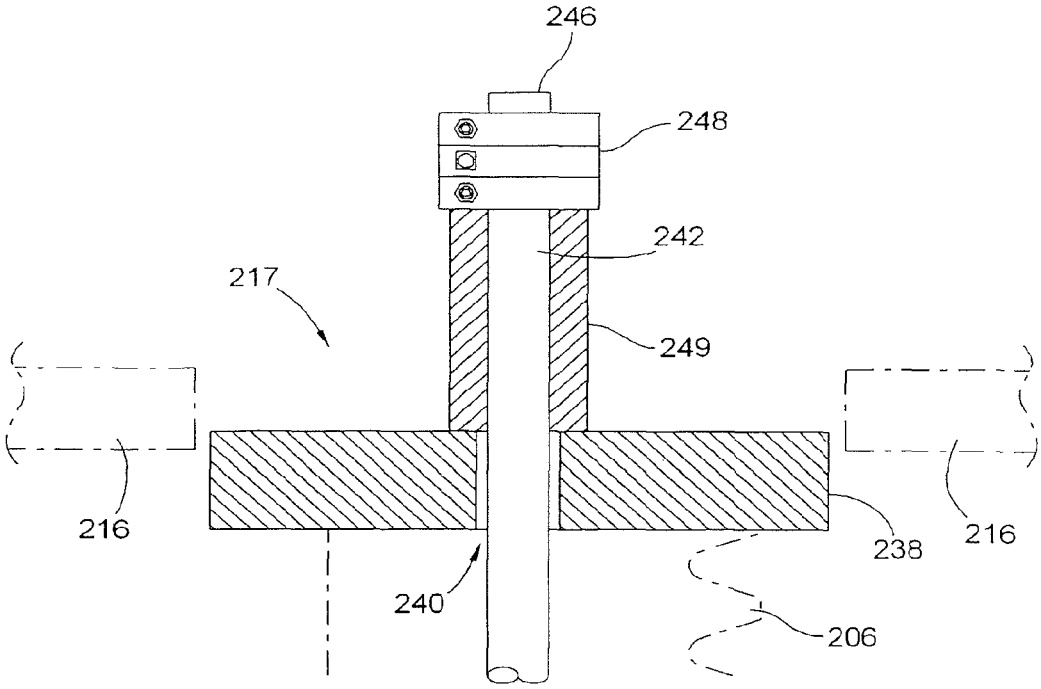
FIG. 9 is an enlarged, partial cross-sectional, schematic illustration of a variation of the second exemplary embodiment having a tubular-shaped spacer disposed between a rod clamp and the upper end of a rack of a rack and pinion arrangement of the second exemplary embodiment of the invention.

As shown in FIG. 9, which is a section view taken along line 9-9 in FIG. 8, the rack 206 of the exemplary embodiment 200 has a substantially U-shaped cross-section, with first and second legs 224, 226 extending from a bight section 228 in such a manner that the legs and bight 224, 226, 228 define a longitudinally extending opening in the rack 206 in the form of an open channel 230 disposed about the pumping axis 220. An outer surface 232 of the bight 228, facing substantially oppositely from the legs 226, 228 of the rack 206, is configured to form gear teeth of the rack 206 for engagement with corresponding gear teeth in the pinion 208.

The longitudinally directed channel 230 in the rack 206 extends along the pumping axis 220 from a bottom end 234 of the rack 206 to a top end 236 of the rack 206, with the upper end 236 of the rack 206 being adapted for operative attachment thereto of the polished rod 52. Specifically, as shown in FIG. 8, the upper end 236 of the rack 206 includes a top plate 238 having a hole 240 extending therethrough and defining an upper load bearing surface 241 of the upper end 236 of the rack 206.

The linear mechanical actuator apparatus 204, of the second exemplary embodiment of the linear rod pumping apparatus 200, also includes an actuator rod 242, having a lower end 244 thereof fixedly attached to the top end of the polished rod 52 by a threaded joint or other appropriate type of coupling. The actuator rod 242 extends upward from the lower end 244, through the channel 230 in the rack 206 and the hole 240 in the top plate 238 of the rack 206, and terminates at and upper end 246 of the actuator rod 242 which is disposed above the bearing surface 241 on the upper surface of the top plate 238 of the rack 236. A rod clamp 248 is fixedly attached below the upper end 246 of the actuator rod 242 and above the upper end 236 of the rack 206. The clamp 248 has a lower load bearing surface thereof adapted for bearing contact with the upper load bearing surface 241 of the upper end 236 of the rack 206, for transferring force between the actuator rod 242 and the upper end 236 of the rack 206 when the lower load bearing surface of the clamp 248 is in contact with the upper load bearing surface 241 on the upper end 236 of the rack 206.

The clamp 248, of the exemplary embodiment 200 forms an expanded upper end of the actuator rod 242 having a configuration that is incapable of entry into or passage through the hole 240 in the upper end 236 of the rack 206. It will be further appreciated that, to facilitate installation of the linear rod pumping apparatus 200 on the well head 54, the actuator rod 242 may be allowed to extend some distance beyond the collar 248, to thereby provide some measure of adjustment to accommodate variations in the positioning of the upper end of the polished rod 52, with respect to the lower end of the lower section 218 of the housing of the linear mechanical actuator arrangement 204. The upper section 214, of the housing of the linear mechanical actuator arrangement 204 includes sufficient head space to accommodate a portion of the actuator rod 242 extending above the clamp 248. It will be appreciated that, in some embodiments of the invention, a linear rod pumping apparatus 200 may be formed without the actuator rod 242 such that the polished rod 52, or an extension thereof, may be fed longitudinally entirely through the rack 206 and clamped above the upper end 236 of the rack 206 with a clamp 248. It is contemplated, however, that the addition of the actuator rod 242 will substantially facilitate installation of a linear rod pumping apparatus according to the invention.

As shown in FIG. 9, some forms of the second exemplary embodiment 200 of the invention may also include a tubular-shaped spacer 249 disposed about the actuator 242 between the clamp 248 and the top plate 238 of the rack 206. Such a spacer 249 may be utilized when practicing the invention with a clamp 248 having a peripheral dimension which is larger than an opening 217 in the center section 216 of the housing.

Figure 10:
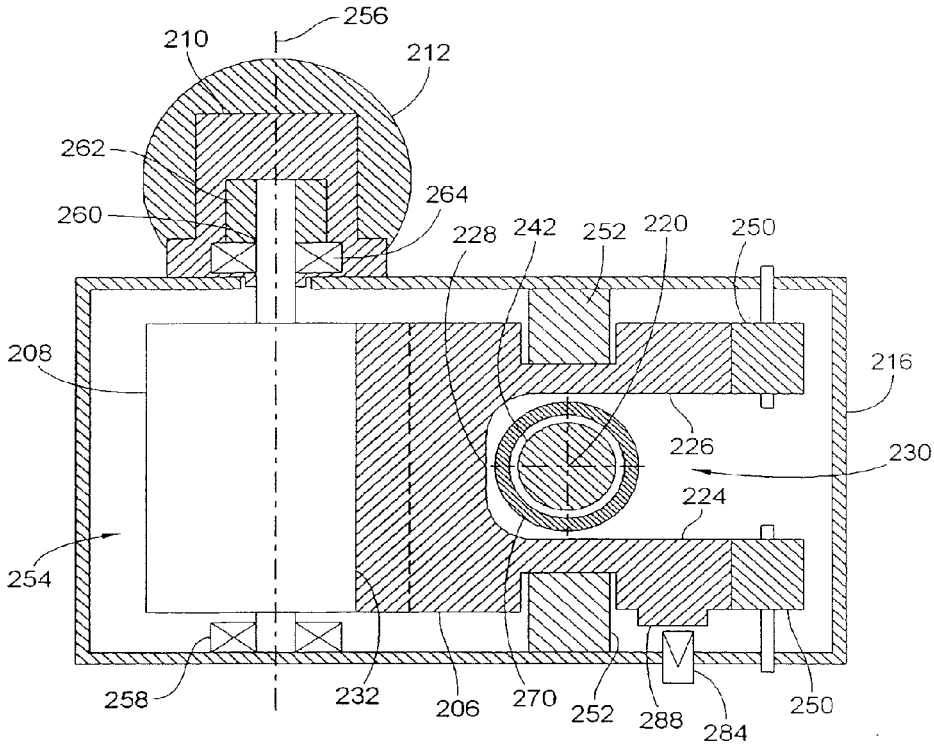
FIG. 10 is a schematic cross-sectional illustration, taken along line 10-10 in FIG. 8.

As shown in FIGS. 7, 8 and 10, the linear mechanical actuator arrangement 204 of the second exemplary embodiment 200 of the invention includes four guide rollers 250 arranged in two pairs, attached to the center section 216 of the housing substantially opposite the pinion 208, and configured to bear against the longitudinally extending distal edges of the legs 226, 228 of the rack 206 for urging the rack 206 into a gear mesh relationship with the pinion 208. Two guide bars 252, operatively extending from the middle section 216 of the housing and substantially opposite from one another, are provided for urging the rack 206 into alignment with the pinion 208.

The middle section 216 of the housing functions as a pinion housing, having a longitudinally extending opening 254 (see FIG. 10) disposed about the pumping axis 220 for passage therethrough of the rack 206, and defining a rotational axis 256 of the pinion 208, with the pinion axis 256 being laterally offset from, and extending substantially perpendicularly to, the pumping axis 220.

A first, anti-drive end of the pinion 208 is journaled in a pinion bearing 258 disposed in, and mounted to, the pinion housing 216. The second, drive end 260 of the pinion 208, in the linear mechanical actuator 204 of the second exemplary embodiment 200, is adapted for connection to an output element 262 of the gearbox 210 and is supported by an output bearing 264 of the gearbox 210. By virtue of this arrangement, the output bearing 264 of the gearbox 210 serves two functions and provides a more compact assembly than would be achievable in an embodiment of the invention having an additional bearing attached to the middle housing 216 for supporting the drive end 260 of the pinion 208. In other embodiments of the invention, however, an additional bearing may be provided for supporting the drive end 260 of the pinion 208.

To further reduce the size of the second exemplary embodiment of the linear rod pumping apparatus 200, the gearbox 210 is a right angle gear box having input and output elements 266, 262 (see FIGS. 7 and 10) arranged substantially at a right angle to one another, with the output element 262 being oriented for alignment with, and rotation substantially about, the pinion axis 256, and the input element 266 of the gearbox 210 and the rotatable shaft 222 of the motor 212 being oriented substantially parallel to the pumping axis 220. It will be understood that, in other embodiments of the invention, a motor 212 may be operatively attached to the pinion 208 by a variety of other means and in other relative orientations.

As best seen in FIG. 8, the linear mechanical actuator arrangement 204, of the second exemplary embodiment 200 of the invention, also includes an oil sump, formed by the lower section 218 of the housing, and configured for containing a sufficient volume of lubricant therein, such that a lower portion of the rack 206 is immersed into the lubricant during at least a portion of each stroke 84 of the pump 68 (FIG. 2). The sump includes inner and outer longitudinally extending radially spaced tubular walls 270, 272 sealingly connected at lower ends thereof by the bottom end of the lower section 218 of the housing, to thereby define an annular-shaped cavity therebetween, for receipt within the cavity of the volume of the lubricant, and terminating in an annular-shaped opening between upper ends of the inner and outer tubular walls 270, 272. As will be understood from an examination of FIGS. 8 and 9, the inner tubular wall 270 of the sump 268 has an inner periphery thereof disposed about the actuator rod 242, and an outer periphery thereof disposed within the channel 230 in the rack 206. The outer tubular wall 272 of the sump 268 has an inner periphery thereof disposed about the rack 206.

As shown in FIG. 8, the inner tubular wall 270 extends substantially above a fluid level 274 of the lubricant within the sump 268, even when the rack 206 is positioned in a maximum downward location thereof, so that the lubricant is precluded from flowing over the top end 275 of the inner tubular wall 270. By virtue of this arrangement, it is not necessary, in the exemplary embodiment 204 of the linear actuator arrangement of the second exemplary embodiment 200 of the invention, to provide any sort of packing between the lower end of the lower section 218 of the housing and the polished rod 52, or the actuator rod 242. It will be noted, however, that in other embodiments of the invention, other arrangements for providing lubrication of the rack in a sump may be utilized, wherein it would be desirable to provide a packing between the rod 52, 242 and the lower end of the lower section 218 of the housing of the linear mechanical actuator arrangement 204.

With reference to FIG. 7, it is further contemplated that, in some embodiments of the invention, it may be desirable to have the cross-sectional area of the sump 268 match the cross-sectional area of the rack 206, or a lower end plate 276 (see FIG. 8) closely enough so that immersion of the rack into the sump 268 generates hydraulic damping of the movement of the rack 206.

As shown in FIGS. 7 and 8, the linear mechanical actuator arrangement, in the second exemplary embodiment of a linear pumping apparatus 200 according to the invention, includes a pair of nested helical compression springs 278, 280, operatively positioned within the annular cavity in the bottom of the sump 268, below the lower end 234 of the rack 206, and configured for engaging and applying an upwardly directed force to the lower plate 276 on the lower end 234 of the rack 206, when the lower end plate 276 comes into contact with a longitudinally movable spring contact plate 282 configured to rest on an upper end of the springs 278, 280 and move longitudinally along the inner tubular wall 270 as the springs 278, 280 act on the lower end 234 of the rack 206.

In the exemplary embodiment 200, the springs 278, 280 are configured for engaging and applying an upwardly directed force to the lower end 236 of the rack 206 only when the lower end 234 of the rack 206 has moved beyond a normal lower position of the rack 206 during a pump stroke. Such an arrangement provides a safety cushion to safely bring the rack and rod string slowly to a halt in the event that a fault condition should result in the rack 206 moving downward to a longitudinal position lower than would be attained during a normal pump stroke. By virtue of this arrangement, a potentially damaging impact between components of the linear mechanical actuator arrangement and/or between the stationary and traveling members of the pump 68 is precluded.

In other embodiments of the invention, however, the springs 278, 280 may be configured in such a manner that they engage and apply an upwardly directed force to the lower end of the rack during a portion of each pump stroke, to thereby recover a portion of the kinetic energy generated by the weight of the rod string and pump during the downward portion of the pump stroke under the force of gravity and utilize that stored energy in the springs 278, 280 for aiding the action of the linear rod pumping apparatus during the upward portion of the stroke, in addition to precluding mechanical damage the rack 206 or other components at the bottom of each pumping stroke.

As best seen in FIGS. 8 and 10, the second exemplary embodiment of a linear rod pumping apparatus 200 also includes a position sensing arrangement for sensing a position of the rack 206 along the pump axis 220. Specifically, the position sensing arrangement of the second exemplary embodiment 200 includes a stationary position sensor 284 disposed adjacent the rack 206 at a mid-stroke position along the pumping axis 220 in combination with upper and a lower sensor flags 286, 288 attached to the rack 206, respectively, at the upper and lower ends 236, 234 of the rack 206. The first and second sensor flags 286, 288 are positioned along the first leg 244 of the rack 206 in such a manner that the flags 286, 288 are brought into juxtaposition with, and sensed by, the sensor 284 during each complete pumping stroke.

The upper sensor flag 286 and lower sensor flag 288 are axially spaced from one another along the rack 286 to form a gap between the upper and lower flags 286, 288 with the gap being substantially centrally longitudinally disposed along the rack 206. The upper sensor flag 286 extends substantially from the upper end 236 of the rack 206 to a lower edge 290 of the upper sensor flag 286, which defines an upper end of the gap between the upper and lower sensor flags 286, 288. The lower sensor flag 288 extends substantially from the lower end of the rack 206 to an upper edge 292 of the lower sensor flag 288, to thereby define the lower end of the gap between the upper and lower sensor flags 286, 288.

Figure 11:
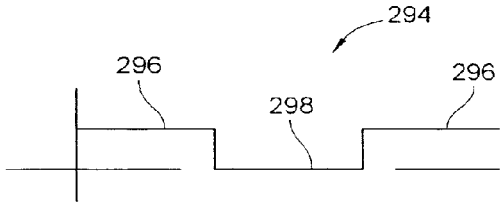
FIG. 11 is a graphical illustration of an exemplary substantially square-wave output produced by a sensing mechanism, according to the invention, of the second exemplary embodiment of the linear rod pumping apparatus, according to the invention, as shown in FIGS. 8 and 10.

By virtue of this arrangement, the sensor 284 produces an output, as shown in FIG. 11, having a substantially square wave 294 shape, with a step change from a first state 296, while one or the other of the flags 286, 288 is juxtapose with the sensor 284, to a second state 298, when the gap is juxtapose with the sensor 284.

The sensing arrangement described above, in relation to the second exemplary embodiment 200 of the invention, can be used with great efficacy in combination with control apparatuses and methods of the type described in commonly assigned U.S. Pat. No. 7,168,924 B2, to provide a highly precise, accurate, effective and efficient calculation of the polished rod position and control of the linear rod pumping apparatus 200. The exemplary embodiment of the sensing arrangement described above can also be utilized to control the motor 212 in such a manner that downward motion of the rack 206 is slowed as the bottom of the pump stroke is approached through braking action of the motor 212, to thereby provide an electrically controlled velocity profile, which may be used in addition to, or in place of, the springs 278, 280 of the second exemplary embodiment of a linear rod pumping apparatus 200.

Figure 12:
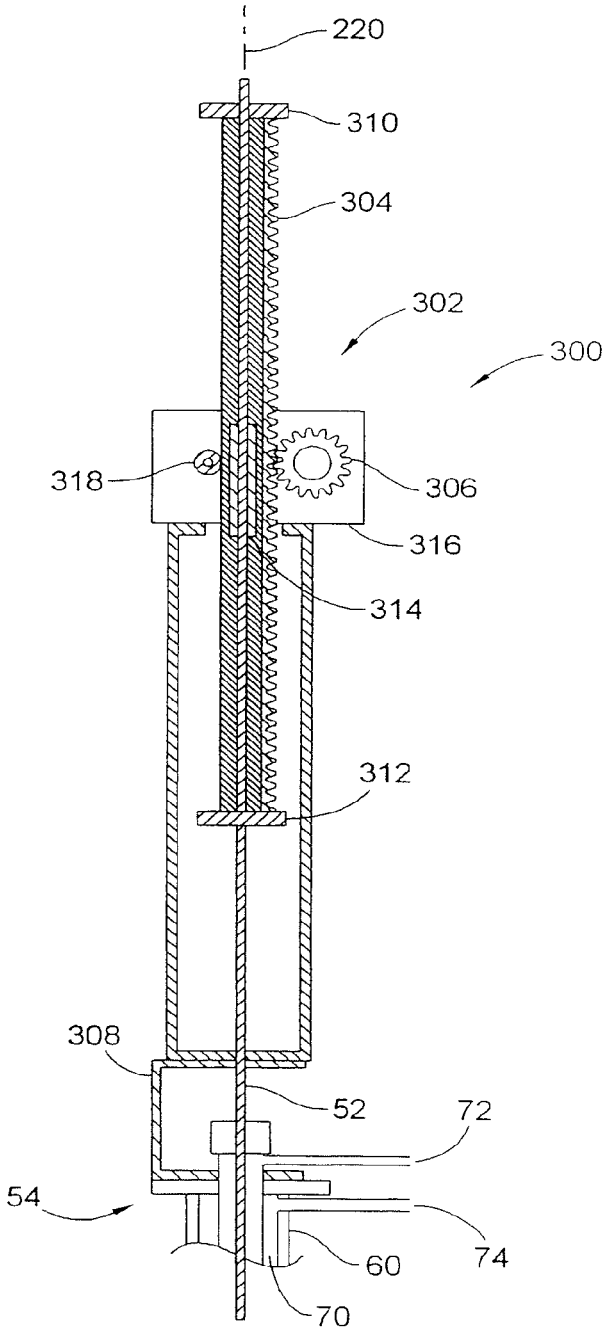
FIG. 12 is a schematic cross-section of a third exemplary embodiment of a linear rod pumping apparatus, according to the invention.

FIG. 12 shows a third exemplary embodiment of a linear rod pumping apparatus, according to the invention, having a linear mechanical actuator apparatus 302, including a rack 304 and pinion 306 gear train arrangement, similar to the rack and pinion arrangement of the second exemplary embodiment 200 described above. The linear mechanical actuator 302, of the third exemplary embodiment 300, as shown in FIG. 11, is mounted directly to the well head 54, through a standoff arrangement 308.

The third exemplary embodiment of a linear rod pumping apparatus 300, according to the invention, is similar in many respects to the second exemplary embodiment 200, described above, with several exceptions. In the third exemplary embodiment 300, the polished rod 52 is shown as extending completely through the rack 304 along the pumping axis 220, and is secured at both the upper and lower ends of the rack 304 by upper and lower end plate and clamp arrangements 310, 312. A stop block 314 is fixedly attached to the middle section 316 of the housing, in such a manner that the end plate and clamping arrangements 310, 312 will contact the stop block 314, and arrest further movement of the rack 304, to preclude having the rack 304 run off of the pinion 306.

The third exemplary embodiment of the linear pumping rod apparatus 300 also includes only a single pair of guide rollers 318, disposed for urging the rack 304 into a gear mesh arrangement with the pinion 306.

In the form illustrated in FIG. 12, the linear mechanical actuator arrangement 302 of the third exemplary embodiment of the linear rod pumping apparatus 300 further, does not include the oil sump 268 or the springs 278, 280 of the second exemplary embodiment. It will be understood, however, that in alternate embodiments of the invention, various features of the exemplary embodiment shown herein can be used, omitted, or combined together in forms other than the exemplary embodiments of the invention shown in the drawings and specifically described herein.

Figure 13:
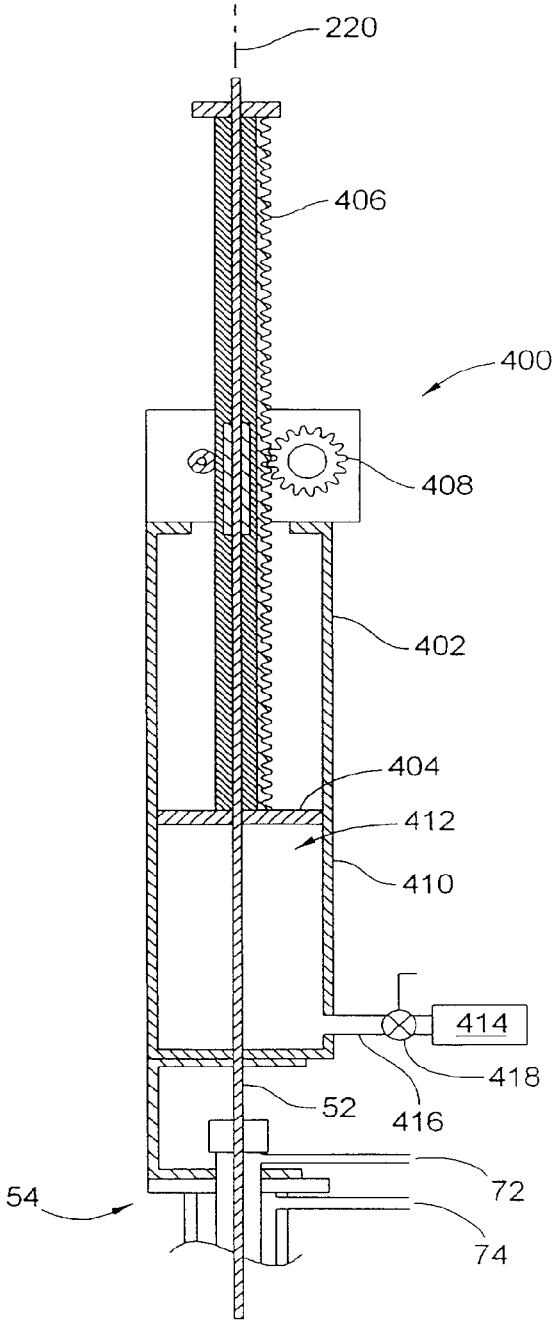
FIG. 13 is a schematic cross-sectional illustration of a fourth exemplary embodiment of a linear rod pumping apparatus, according to the invention, which includes a pneumatic storage apparatus and regulator, for supply a counter-balance force to elements of the linear rod pumping apparatus.

FIG. 13 shows a fourth exemplary embodiment of a linear rod pumping apparatus 400, according to the invention, in which a linear mechanical actuator arrangement 402 that is substantially identical to the linear mechanical actuator arrangement 302 of the third exemplary embodiment 300 of the invention described above, includes a piston plate 404 attached to the lower end of the rack 406 of the rack 406 and pinion 408 arrangement, and the lower end of the lower section 410 of the housing is cooperatively configured with the piston plate 404 in such a manner that a gas tight cylinder is provided, below the piston plate 404. A pneumatic storage apparatus 414, such as an accumulator, is connected to the pneumatic cylinder chamber 412 through a conduit 416, and a regulator 418 is disposed between the accumulator 414 and the cylinder 412 for regulating pressure and volume of the gas stored in the pneumatic cylinder and accumulator 412, 414.

By virtue of this arrangement, a counter-balance force may be applied to the lower end of the rack 406. Although only a singular accumulator 414 and regulating valve 418 are illustrated in FIG. 12, in some embodiments of the invention it may be desirable to have multiple accumulators and/or regulating valves 414, 416, to aid in adjusting the counter-balance force applied to the lower end of the rack. Some embodiments of the invention may also include venting part, or all of the pressure generated in the pneumatic cylinder cavity 412 on the downstroke. In the exemplary embodiment shown in FIG. 13, the interior of the lower section 410 of the housing is vented to atmosphere above the highest level of travel of the piston plate 404.

It will be understood, that the pneumatic counter-balancing arrangement of the fourth exemplary embodiment 400 of the invention may also be incorporated into other embodiments of the invention, including some or all of the features of the first and second exemplary embodiments 100, 200 of the invention described above.

Figure 14:
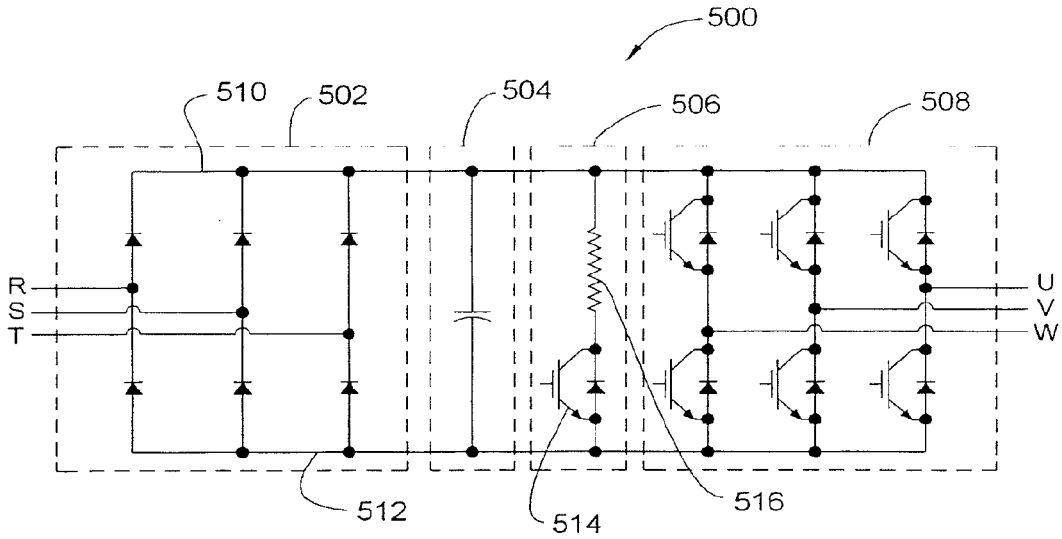
FIG. 14 shows a first exemplary embodiment of a motor drive, for use in a control arrangement in embodiments of the invention having an electric motor.

FIG. 14 shows a first exemplary embodiment of a motor drive 500 for use in a control arrangement in embodiments of the invention having an electric motor. The motor drive 500 includes a rectifier bus charging section 502, a capacitor bank section 504, a dynamic braking section 506, and an inverter motor output section 508 connected along common bus rails 510, 512, for connecting a three phase power input R, S, T to a three phase output U, V, W, provided to the motor.

When the motor is drawing power, diodes in the charging section 502 charge the capacitor bank 504 and an IGBT bridge arrangement in the inverter motor output section 508 modulates capacitor voltage to control current in the motor windings.

When the motor is regenerating power, due to braking action, as the rod string pulls the rack downward on the return/fill portion of the pump stroke, for example, diodes in the inverter motor output section 508 transfer power to the capacitor bank 504, causing capacitor bank voltage to rise. The first exemplary embodiment of the motor drive 500 provides two options for dealing with the energy that is transferred to the capacitor bank during braking. In some forms of the invention, the capacitor bank 504 includes sufficient capacitance to store the energy generated during braking action, without exceeding voltage limits on the rails 510, 512. Alternatively, a dynamic braking IGBT 514 in the dynamic braking section 506 may be turned on to allow the energy generated during braking action to be dissipated across a dynamic braking resistor 516 of the dynamic braking section 506.

Figure 15:
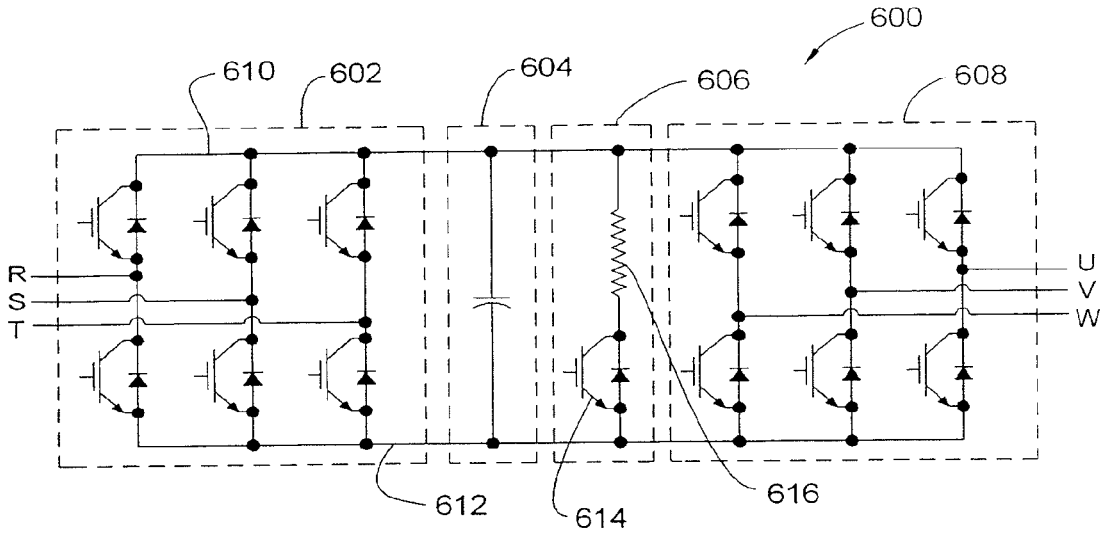
FIG. 15 shows a second exemplary embodiment of a motor drive, for use with an electric motor in practicing the invention.

FIG. 15 shows a second exemplary embodiment of a motor drive 600 for use with an electric motor in practicing the invention. The second exemplary embodiment of the motor drive 600 is substantially identical to the first exemplary embodiment of the motor drive 500, as described above, except that an IGBT switching bridge is provided in parallel with the diodes in the rectifier section to provide a regenerative bus charging section 602, a capacitor bank section 604, a dynamic braking section 606 and an inverter motor output section 608 disposed across a pair of common rails 610, 612 for connecting a three phase R, S, T input to the motor drive to a three phase U, V, W connection to the motor.

In the second exemplary embodiment of the motor drive 600, when the motor is drawing power the diodes in the regenerative bus charging section 602 charge capacitors in the capacitor bank 604 and an IGBT bridge in the inverter motor output section 608 modulates capacitor voltage in the capacitor bank section 604 to control current in the motor windings.

In the second exemplary embodiment of the motor drive 600, when the motor regenerates power due to braking action, diodes in the inverter motor output section transfer power to the capacitor bank 604, causing capacitor bank voltage to rise. The second exemplary embodiment of the motor drive 600 provides three options for dealing with the energy being transferred to the capacitor bank.

In one option, the capacitor bank section 604 has sufficient capacitance to store the energy generated during braking, without exceeding voltage limits.

With the second option, a dynamic braking IGBT 614 of the dynamic braking section 606 is turned on, and all, or a portion of the energy generated during braking, is dissipated across a dynamic braking resistor 616 of the dynamic braking section 606.

In the third optional mode of operation, the IGBTs in the regenerative bus charging section are switched to modulate the capacitor voltage of the capacitor bank section in such a manner as to allow a transfer of the power generated during braking back to the incoming three phase R, S, T source.

Those having skill in the art will recognize that, through practice of the invention, significant advantages are provided as compared to prior pumping apparatuses and methods, such as the control of a walking-beam-type, or a belt-driven, pumping apparatus controlled by a rod pump control system as disclosed in the above-referenced, commonly assigned, U.S. Pat. No. 7,168,924 B2, to Beck et al., titled "Rod Pump Control System Including Parameter Estimator." It will be further recognized that a rod pump control system, including parameter estimation, of the type disclosed in Beck et al., U.S. Pat. No. 7,168,924 B2, may be used with considerable efficacy in combination with a linear rod pumping apparatus, according to the present invention, with the disclosure and teachings of Beck et al. being incorporated herein, in their entireties, by reference.

For example, it will be readily appreciated that in a linear rod pumping apparatus, according to the invention, the surface position of the pump rod, and the current load on the pump rod above the surface of the ground may be readily determined, without the need for down-hole sensors, by virtue of the elegantly simple construction of the linear mechanical actuator arrangement and the direct relationship that exists between the vertical position of the vertically movably member of the linear mechanical actuator arrangement and the rotatable element of the motor. Where the motor is an electric motor, for example, the vertical position of the vertically movable member can be directly determined from the angular rotational position of the motor shaft, and the load on the rod above the surface of the ground can be readily determined from motor current and voltage, in accordance with the apparatuses and methods of a rod pump control system including parameter estimation, as taught by Beck et al., or through the use of other applicable methods and apparatuses in accordance with the teachings with the present invention. Other parameters useful for controlling a linear rod pumping apparatus, in accordance with the invention, such as direction and speed of the vertical member and/or the motor shaft, and the magnitude and direction of motor torque can also readily be obtained through use of a rod pump control system according to Beck et al., or any other appropriate apparatus and method in accordance with the presence invention.

Once the above-ground parameters, such as surface rod position and load are determined for a linear rod pumping apparatus, according to the invention, a model of dynamic rod performance, of the type disclosed in Beck et al., or any other appropriate apparatus or method for modeling the dynamic performance of the pump rod, may be utilized to determine a down-hole pump position and load. The pump dynamic model may then also be utilized to determine pump "fillage" as a percentage of the total capacity of the sucker-rod pump, in real time.

Operation of the linear rod pumping apparatus can then be controlled and adjusted to provide a vertical stroke length and speed of the vertically movable member of the linear rod pumping apparatus, according to the invention, to achieve a target desired pump fillage percentage. Practice of the invention also contemplates controlling the linear rod pumping apparatus in a manner consistent with optimizing other performance parameters of a particular well installation, such as minimizing power consumption by the motor for a given volume of pumped fluid, or minimizing variation in the level of input power draw in a manner which might be desirable in hydrocarbon well installations wherein the motor of the linear rod pumping apparatus receives input power from an engine-driven generator.

Those having skill in the art will readily recognize that the elegantly simple construction of a linear rod pumping apparatus, according to the invention, results in the operating members having very low inertias, as compared to prior pumping apparatuses.

Those having skill in the art will further recognize that the elegant simplicity of construction and operation of a linear rod pumping apparatus, according to the invention, is inherently much more readily controllable than walking-beam-type apparatuses in which complex kinematic motions and large inertias of multiple interconnected parts must be taken into consideration, in the manner disclosed, for example, in the Beck et al. U.S. Pat. No. 7,168,924 B2, in order to determine the present position and loading on the pumping apparatus and control the input being provided by the pumping apparatus to the pump rod. The complexities, and in particular the high inertias, of prior pumping apparatuses also make it difficult to efficiently and effectively provide control inputs for modifying performance of the down-hole pump in real time.

The low inertia of a linear rod pumping apparatus, according to the invention, provides particular advantages in affecting real time control of the pumping apparatus, in a manner consistent with achieving a desired performance from the sucker-rod pump. In some modes of operation, however, the low inertia of a linear rod pumping apparatus, according to the invention, must be taken into account and compensated for, to preclude having the weight of the rod string and fluid load accelerate the vertically movable member of the linear rod pump downward more rapidly than is desirable during the downward portion of the pump stroke under conditions such as a loss of power to the motor, for example, or periods of operation in which the traveling valve of the sucker-rod pump is not immersed in fluid having sufficient viscosity to provide hydraulic damping of the downward movement of the traveling valve and rod string. Under such operating conditions, the controlled stop provisions at the bottom of the motion of the apparatus, as described above, as provided mechanically through spring elements, or electrically through braking of the motor are provided by the present invention, for use in combination with a rod pump control system such as the one described in Beck et al., or another appropriate control system to preclude having the rod string drive the vertically movable member of a linear rod pumping apparatus, according to the invention, at an undesirably high speed and/or acceleration rate, and to preclude damaging of the down-hole pump components by preventing "tagging" of the standing valve by the traveling valve.

With specific reference to the second exemplary embodiment of a linear pumping rod apparatus 200, according to the invention, as described above, a method of operating a linear rod pumping apparatus, according to the invention, might include the following eight steps. During all eight steps, the instantaneous vertical velocity of the rack 206 is calculated from the instantaneous angular velocity of the motor shaft 222, and the position of the actuator rod 242 is calculated by integration using the instantaneous vertical velocity of the actuator rod 242.

Step 1.

Begin with the actuator rod 242, in a fully lowered position, and attached to the upper end of the polished rod 52

Step 2.

The motor 212 is then energized to accelerate the rod to a predetermined "UP SPEED."

Step 3.

As the motor 212 drives the rack 206 upward, to thereby accelerate the actuator rod 242 to UP SPEED, the output signal 294 (see FIG. 10) of the stationary position sensor 284 is monitored to detect the rising edge of the square-wave 294 caused by the upper edge 292 of the lower reference flag 288 coming into juxtaposition with the position sensor 284.

If the upper edge 292 is detected before the rod 242 reaches a calculated vertical rod position, corresponding to a desired pump stroke, where the upper edge 292 is within a predetermined reference position window, or where the upper edge 292 is not detected within a predetermined period of time or a predetermined angular rotation of the motor shaft 222, a fault condition is identified and the motor 212 is operated in such a manner that the rack 206 and actuator rod 242 are lowered to the fully lowered position at a very slow speed. Once the fully lowered position is achieved, the method may begin again by returning to step 1.

If the upper edge 292 of the lower reference flag 288 is detected, however, while the calculated rod position is within the predetermined raised rod reference position window, the calculated rod position is set to the raised rod reference position value, and the instantaneous vertical position of the actuator rod 242 is calculated by integration using the upward velocity of the actuator rod 242.

Step 4.

As the actuator rod 242 approaches a desired top of stroke position, the motor 212 is operated in such a manner that the upward speed of the rod 242 decelerates so that the upward velocity is reduced to substantially zero at the desired top of stroke position.

Step 5.

From the top of stroke position, the motor 212 is operated in such a manner that the actuator rod 242 accelerates to a "DOWN SLOW SPEED." From the foregoing description of exemplary embodiments, it will be understood that during downward motion of the actuator rod 242, the motor 212 is operated in a braking mode, by commanding the motor 212 to drive the pinion 208 at a slower rotational speed than the pinion 208 would otherwise achieve due to the downward forces on the rack 206 caused by the weight of the rod string and any fluid loads acting on the sucker-pump apparatus, so that a net braking torque is applied to the pinion 208.

Step 6.

As the rod 242 moves downward, at DOWN SLOW SPEED, the output of the position sensor 282 is monitored to detect a rising edge of the reference signal 294 caused by the lower end 290 of the upper reference flag 286 coming into juxtaposition with the position sensor 282. If this edge 290 is detected before a predetermined calculated rod position whereat the rod 242 is within a lowered rod reference position window, or is not detected, a fault condition is identified and the motor 212 is operated in such a manner that the actuator rod 242 is lowered to the fully lowered position at a very low speed. Once the actuator rod 242 has reached the fully lowered position, the method may then return to step 1 above. If, however, the lower edge 290 of the upper reference flag 286 is detected, while the calculated rod position is within a desired lower rod reference position window, the calculated rod position is reset to the measured lowered rod reference position value, and the rod 242 is allowed to continue downward, while rod position is calculated by integration of the downward velocity of the rod 242.

As the actuator rod 242 is lowered, load on the down-hole pump is determined, by monitoring motor torque, for example. When the load on the down-hole pump drops to a very low level, i.e. drops below a predetermined threshold indicating that the traveling valve has opened, the motor 212 is operated such that the actuator rod 242 can accelerate to a "DOWN FAST SPEED."

Step 7.

As the actuator rod 242 continues downward at DOWN FAST SPEED, the vertical position of the actuator rod 242 is monitored, and the down-hole position of the traveling valve is calculated. As the actuator rod 242 approaches a predetermined bottom of stroke position, which may be vertically above the fully lowered position of the actuator rod 242, the motor 212 is operated in a braking mode, to provide a velocity profile, such that the actuator rod 242 is decelerated to substantially zero velocity at the desired bottom of stroke position.

Step 8.

Once the actuator rod 242 has reached the desired bottom of stroke position, operation of the linear rod pumping apparatus 200 is continued by returning to step 2 above, and repeating steps 2-8 for each pump stroke.

With reference to FIGS. 2 and 13, operation, according to the invention, of a linear pumping apparatus having an electric motor driven by a motor drive 110, 500 controlled by a controller 108 will be described, for a "power loss" fault condition, wherein the method may include the following four steps:

Step A.

The controller 108 detects a loss of line power whenever voltage across the common power busses 510, 512 drops below a predetermined minimum threshold value.

Step B.

If the actuator rod 242 is moving upward, at the time that a line power loss is detected, the controller 108 commands the motor 104, 212 to enter a reverse braking mode in which the motor 104, 212 acts as a generator as the rack 206 continues to move upward, due to inertia in the linear rod pumping apparatus, to keep the voltage across the busses 510, 512 at a level which would allow the motor drive 110, 500 to continue to control the motor 104, 212.

Step C.

If the actuator rod 242 is moving downward, at the time that a line power loss is detected or after braking action of Step B has caused the actuator rod 242 to begin downward motion, the controller 108 commands the motor 212 to operate in a braking mode, to limit the lowering speed of the actuator rod 242 in such a manner that impact forces are reduced when the rack 206 contacts the springs 278, 280, and also causing the motor 104, 212 to act as a generator and keep the voltage across the busses 310, 312 at a level which allows the motor drive 110, 500 to continue to control the motor 104, 212.

Step D.

When the actuator rod 242 has reached a fully lowered position, the voltage across the busses 310, 312 will decay and the motor drive 110, 500 is turned off until line power is restored.

Those having skill in the art will recognize, that the above-described exemplary embodiments of normal operation and various fault conditions, for exemplary embodiments of the invention, are provided solely for the purpose of helping the reader to more fully understand the invention, and are by no means intended to limit the scope of the invention. It will be further understood, that the invention may be practiced in a wide array of other forms, within the scope of the invention.

Those having skill in the art will also appreciate, that a linear rod pump apparatus and/or method, according to the invention, provides significant advantages, in addition to being physically smaller, in comparison to both a conventional walking beam pumping apparatus, and other prior pumping apparatuses, such as the hydraulic motor driven pump jack device of Saruwatari.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A linear rod pumping apparatus, for imparting reciprocating substantially vertical motion to a rod of a sucker-rod pump having a pump stroke, the apparatus comprising:

a linear mechanical actuator arrangement, having a substantially vertically movable member attached to a polished rod of the sucker-rod pump for imparting and controlling vertical motion of the polished rod of the sucker-rod pump, the linear mechanical actuator arrangement comprises:

a rack and pinion gearing arrangement, with the rack being disposed for operation in a substantially vertical direction for reciprocating motion along a pumping axis; and the rack being operatively connected in gear mesh relationship with the pinion;

a motor operatively connected to the vertically movable member of the linear mechanical actuator arrangement with the pinion operatively coupled to the rotating output of the motor establishing a fixed relationship between the rotational position of the motor and the vertical position of the vertically movable member with the motor configured to exert a force on the rack in one direction and in another opposite direction; and a control arrangement operatively connected to the motor, for controlling the motor, the control arrangement operates the motor in a driving mode, for applying torque to the pinion in a first direction to urge rotation of the pinion in the first direction, to urge upward movement of the rack on an upward portion of the stroke of the polished rod, and the control arrangement operates the motor in a braking mode, for applying a net torque to the pinion in the first direction for resisting rotation of the pinion in the opposite direction, during downward movement of the rack on a downward portion of the stroke of the polished rod, the control arrangement includes, sensing arrangements for sensing one or more parameters of the group of parameters consisting of: linear position of the rack along the pumping axis, rotational position of the pinion about the pinion axis, motor torque, motor speed, motor acceleration, and motor input power.

2. The apparatus of claim 1, the control arrangement further comprises an energy storage element for storing energy generated during the braking mode of operation of the motor.

3. The apparatus of claim 2, wherein, the control arrangement is configured for utilizing the stored energy in the energy storage element to assist in driving the motor during the driving mode.

4. The apparatus of claim 1, wherein, the control arrangement further comprises a polished rod dynamics model for use in controlling operation of the motor.

5. The apparatus of claim 1, wherein, the sensing arrangement is configured to determine linear position of the rack twice during each pump cycle, once on the upstroke and once on the downstroke.

6. The apparatus of claim 1, wherein, the control arrangement is configured for detecting a fault condition and applying corrective action to operation of the motor.

7. A method for operating a linear rod pumping apparatus including a linear mechanical actuator arrangement and a motor, wherein the linear mechanical actuator has a substantially vertically movable member configured for attachment to a polished rod of a sucker-rod pump to impart and control vertical motion of the polished rod of the sucker-rod pump, and the motor thereof is operatively connected to the vertically movable member of the linear mechanical actuator arrangement with a pinion gear operatively coupled to the rotating output of the motor establishing a fixed relationship between the rotational position of the motor and the vertical position of the vertically movable member, the method comprising:

operating the motor in a manner imparting reciprocating vertical motion to the vertically movable member, with the motor configured to exert a force on the vertically movable member in one direction and in another opposite direction;

operating the motor in a driving mode, for applying torque to the pinion gear in a first direction to urge rotation of the pinion gear in the first direction and upward movement of the vertically movable member on an upward portion of a stroke of the polished rod of the sucker-rod pump; and operating the motor in a braking mode, for applying a net torque to the pinion gear in the first direction for resisting rotation of the pinion gear in the opposite direction during downward movement of the vertically movable member on a downward portion of the stroke of the polished rod of the sucker-rod pump.

8. The method of claim 7, further comprising, determining dynamic operation of the polished rod and controlling the motor in accordance with the dynamic operation of the polished rod.

9. The method of claim 7, wherein, the motor generates energy during the braking mode, and the method further comprises, extracting at least a portion of the generated energy during the braking mode.

10. The method of claim 9, further comprising, utilizing the extracted energy to assist in driving the motor during at least one of the driving and braking modes.

11. The method of claim 9, further comprising, dissipating the energy generated during the braking mode of operation of the motor.

12. The method of claim 7, further comprising, controlling the motor in accordance with sensed values of one or more parameters of the group of parameters consisting of: linear position of the vertically movable member, rotational position of the pinion, motor torque, motor speed, motor acceleration, and motor input power.

13. The method of claim 7, further comprising:

detecting a fault condition from the group of faults consisting of: loss of power to the motor, loss of control of the motor, non-filling of the pump, breakage of the rod, overheating of the motor; and taking corrective action to correct the detected fault.

14. The method of claim 13, comprising, controlling the motor to affect the corrective action.

15. The method of claim 13, wherein, the corrective action taken is one of a group of corrective actions from the group consisting of: applying braking, changing pump stroke length, changing pump stroke frequency, dwelling in a non-pumping state, entering a mode of operation in which the polished rod is slowly lowered to a resting position, and, entering a start-up mode of operation.

16. The method of claim 7, further comprising, sensing a vertical position of the vertically movable member along a pumping axis, and controlling the motor according to the sensed vertical position.

17. The method of claim 16, in which the linear rod pumping apparatus includes a position sensing arrangement comprising: a stationary position sensor disposed adjacent the vertically movable member at a mid-stroke position thereof along the pumping axis, and a sensor flag attached to the vertically movable member and disposed such that the flag is juxtaposed with and sensed by the sensor during each pumping stroke; and the method further comprises, detecting the vertical position of the vertically movable member by detecting juxtaposition of the flag with the sensor during each pump stroke.

18. The method of claim 17, in which the sensing arrangement further comprises: an upper sensor flag and a lower sensor flag axially spaced from one another along the rack to form a gap between the upper and lower flags, with the gap being substantially centrally longitudinally disposed along the rack;

the upper sensor flag extends substantially from the upper end of the rack to a lower edge of the upper sensor flag defining an upper end of the gap between the upper and lower sensor flags;

the lower sensor flag extends substantially from the lower end of the rack to an upper edge of the lower sensor flag defining the lower end of the gap between the upper and lower sensor flags; the method further comprises: detecting the vertical position of the vertically movable member by detecting juxtaposition of the sensor with at least one of the upper and lower sensor flags during each pump stroke.

19. The method of claim 18, further comprising, detecting an output of the sensor having a substantially square wave shape with a step change from a first state while one or the other of the upper and lower flags is juxtaposed with the sensor, to a second state when the gap is juxtaposed with the sensor.

* * * * *